US008387793B2

(12) United States Patent
Minkler

(10) Patent No.: US 8,387,793 B2
(45) Date of Patent: Mar. 5, 2013

(54) VERTICALLY STACKING LITTER BAGS

(75) Inventor: Douglas J. Minkler, Minkler, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 13/109,589

(22) Filed: May 17, 2011

(65) Prior Publication Data

US 2012/0187014 A1 Jul. 26, 2012

Related U.S. Application Data

(62) Division of application No. 12/490,667, filed on Jun. 24, 2009, now Pat. No. 7,971,720.

(51) Int. Cl.

| | |
|---|---|
| ***B65D 19/00*** | (2006.01) |
| ***B65D 33/06*** | (2006.01) |
| ***B65D 33/16*** | (2006.01) |
| ***B65D 33/30*** | (2006.01) |

(52) U.S. Cl. ..... 206/386; 383/21; 383/32; 383/119; 383/120

(58) Field of Classification Search ..... 206/386, 206/503, 554, 595–600; 383/6, 21, 32, 64, 383/66, 117, 119, 120

See application file for complete search history.

(56) References Cited

U.S. PATENT DOCUMENTS

| | | | | |
|---|---|---|---|---|
| 1,753,281 | A * | 4/1930 | Barstow et al. | 383/117 |
| 3,283,992 | A * | 11/1966 | Hanson et al. | 383/119 |
| 3,396,901 | A * | 8/1968 | McFedries, Jr. | 383/119 |
| 4,421,805 | A * | 12/1983 | Prader | 383/32 |
| 5,182,162 | A | 1/1993 | Andrusko | |
| 5,193,712 | A | 3/1993 | Kuppersbusch | |
| 5,339,957 | A * | 8/1994 | Carstens | 206/386 |
| 5,358,335 | A | 10/1994 | LaFleur | |
| 5,609,930 | A * | 3/1997 | Matsunaga et al. | 383/32 |
| 5,722,552 | A | 3/1998 | Olson | |
| 5,788,121 | A * | 8/1998 | Sasaki et al. | 383/120 |
| 5,873,655 | A | 2/1999 | Echeverria | |
| 5,950,833 | A | 9/1999 | James | |
| 6,053,635 | A | 4/2000 | Anderson et al. | |
| 6,176,615 | B1 | 1/2001 | Leimkuehler | |
| 6,220,755 | B1 | 4/2001 | Brown et al. | |
| 6,240,709 | B1 | 6/2001 | Cook | |
| 6,244,443 | B1 | 6/2001 | Nickell et al. | |
| 6,471,402 | B1 | 10/2002 | Burns | |
| 6,604,857 | B2 * | 8/2003 | Buchanan et al. | 383/32 |
| 6,692,148 | B2 | 2/2004 | Totani | |
| 6,887,570 | B2 | 5/2005 | Greene et al. | |
| 6,962,129 | B1 | 11/2005 | Lawson | |
| 7,192,191 | B2 | 3/2007 | Wedi | |
| 7,207,717 | B2 | 4/2007 | Steele | |
| 7,316,201 | B2 | 1/2008 | Rasner et al. | |
| 7,396,163 | B2 * | 7/2008 | McGregor | 383/66 |
| 8,210,746 | B2 * | 7/2012 | Kerr et al. | 383/120 |
| 2002/0112982 | A1 | 8/2002 | Stagray et al. | |
| 2002/0117117 | A1 | 8/2002 | Raymond et al. | |
| 2004/0008908 | A1 | 1/2004 | Shepard | |
| 2004/0264814 | A1 | 12/2004 | Eisenbarth et al. | |
| 2005/0005870 | A1 | 1/2005 | Fritter et al. | |

(Continued)

FOREIGN PATENT DOCUMENTS

| | | |
|---|---|---|
| WO | WO98/50279 | 2/1999 |

*Primary Examiner* — Bryon Gehman
(74) *Attorney, Agent, or Firm* — Ann Lee

(57) ABSTRACT

Bags for granular material with a closure on top of the bag and a vertical handle on the lower end of the bag and having suitable dimensions, static coefficient of friction, creep resistance and containing granular materials of limited flow properties can be vertically stacked without support, for example on a pallet. One such suitable granular material is cat litter.

10 Claims, 12 Drawing Sheets

U.S. PATENT DOCUMENTS

| | | | | |
|---|---|---|---|---|
| 2005/0069227 | A1 | 3/2005 | Steele | |
| 2005/0100252 | A1* | 5/2005 | Rivlin et al. | 383/116 |
| 2005/0175577 | A1 | 8/2005 | Jenkins et al. | |
| 2006/0078233 | A1* | 4/2006 | Winiecki | 383/120 |
| 2006/0188178 | A1 | 8/2006 | Haimerl et al. | |
| 2006/0215942 | A1 | 9/2006 | Steele | |
| 2007/0289543 | A1 | 12/2007 | Petska et al. | |
| 2008/0080794 | A1 | 4/2008 | Kruse et al. | |
| 2008/0202971 | A1* | 8/2008 | Robles et al. | 206/524.2 |
| 2009/0136163 | A1* | 5/2009 | Kerr et al. | 383/120 |

* cited by examiner

VERTICALLY STACKING LITTER BAGS

CROSS-REFERENCE TO RELATED APPLICATIONS

This application is a divisional of application Ser. No. 12/490,667, Now U.S. Pat. No. 7,971,720 filed on Jun. 24, 2009, which is hereby incorporated by reference in its entirety.

BACKGROUND OF THE INVENTION

1. Field of the Invention

The present invention relates to bags of flowable, granular materials, especially pet litter, which can be vertically stacked and shipped on a pallet.

2. Description of the Related Art

Currently, bags of flowable, granular material are typically shipped horizontally and often have substantial headspace/free volume in the bag. Bags stored vertically would provide a larger label viewing area on shelf compared to bags stored horizontally and vertically stacked bags also allow many different product volumes or weights to be shipped in the same footprint. When shipped horizontally, a stable and reversible pallet pattern is a critical determinant in the size of the bag for a given volume of product. Not all bag sizes or volumes are practical with horizontal shipping, thus vertical shipment offers more sizing flexibility. Vertical stacking, for example on a shelf or pallet, also has advantages in terms of handling and display. For horizontally stacked bags, the product in the bag supports the weight of the bags above it, but the bag sidewalls are typically in compression and not in tension. In vertical shipment the bag sidewalls are subjected to horizontal radially directed forces that put the bag sidewalls in tension in the horizontal direction. For this reason, in order to stack flowable, granular materials vertically, these granular materials are typically put into cartons or pails, which have stiff sidewalls. However, bags have advantages in terms of reduced use of material and cost.

Existing vertically stacked bags are generally vacuum packed in order to provide sufficient rigidity or the bags are somehow reinforced on the sidewalls. U.S. Pat. App. 2004/0264814 to Eisenbarth et al. and U.S. Pat. No. 6,220,755 to Brown et al. describe stackable bulk bags with pockets to receive support members. U.S. Pat. No. 6,240,709 to Cook describes a bag for vertical stacking that contains a plurality of vertical sections to provide columnar support for holding the bag upright when the vertical sections are filled with material. U.S. Pat. No. 6,244,443 to Nickell et al. describes an eight-sided bulk bag with stiffened wall panels. U.S. Pat. No. 6,471,402 to Burns discloses horizontal or vertical stacked bags with rigid planar elements that interlock for stacking PCT App. WO98/50279 to Randall et al. describes a stackable hybrid bag/box with a rigid top and diagonal folded flap edges that serve as braces to provide stackability. U.S. Pat. No. 5,950,833 to James discloses a stackable cookie package having substantially cylindrical and tubular cushions for support. U.S. Pat. No. 5,873,655 to Echeverria discloses a stackable, bulk container bag with internal, anchored retaining strips to ensure uniform tensile forces on the walls from top to bottom of the strip. U.S. Pat. No. 5,722,552 to Olson discloses a container bag with a frame for supporting and retaining the bag. U.S. Pat. No. 5,358,335 to LaFleur discloses a stackable bag with an inturned shoulder construction that maintains the generally rectangular cross sectional shape of the bag, even with another bag stacked on top. U.S. Pat. No. 5,193,712 to Kuppersbusch discloses stackable packaging using a carton with a bag inside. While these reinforced bag solutions allow the bags to be stackable, they also increase cost, complexity, and reduce environmental sustainability.

To overcome these problems of the prior art, the current invention is designed to utilize the cost and simplicity advantages of a bag with the stacking stability of pails or carton, without designing structural complexity into the bag walls.

BRIEF DESCRIPTION OF THE DRAWINGS

The foregoing aspects and others will be readily appreciated by the skilled artisan from the following description of illustrative embodiments when read in conjunction with the accompanying drawings, wherein.

Figure 1:
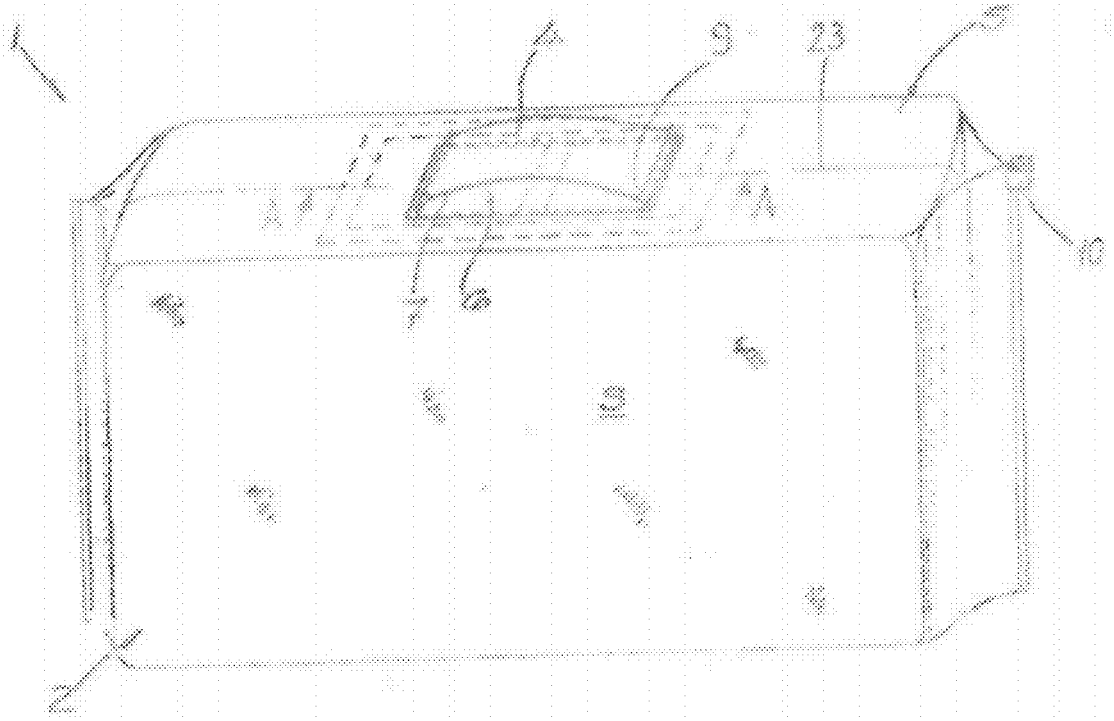
FIG. 1 (Prior Art)
FIG. 1 shows a bag of the prior art having a carrying handle disposed on one of the bag surfaces and a reclosure element disposed on one end of the bag and a seal at the other end of the bag.

Reference will now be made to the drawings wherein like numerals refer to like parts throughout. As used herein, positional terms, such as "bottom" and "top" and the like, and directional terms, such as "up", "down" and the like, are employed for ease of description in conjunction with the drawings. Further, the terms "inner", "interior", "inwardly" and the like, refer to positions and directions toward the geometric center of embodiments of the present invention and designated parts thereof. The terms "outer", "exterior", "outwardly", and the like, refer to positions and directions away from the geometric center. None of these terms is meant to indicate that the described components must have a specific orientation except when specifically set forth.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

SUMMARY OF THE INVENTION

In accordance with the above objects and those that will be mentioned and will become apparent below, one aspect of the present invention comprises In accordance with the above objects and those that will be mentioned and will become apparent below, another aspect of the present invention comprises In accordance with the above objects and those that will be mentioned and will become apparent below, another aspect of the present invention comprises

DETAILED DESCRIPTION OF THE INVENTION

Before describing the present invention in detail, it is to be understood that this invention is not limited to particularly exemplified systems that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference. The citation of any document is not to be construed as an admission that it is prior art with respect to the present invention.

As used herein, forms of the words "comprise", "have", and "include" are legally equivalent and open-ended and do not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, only exemplar materials and methods are described herein.

In the application, effective amounts are generally those amounts listed as the ranges or levels of ingredients in the descriptions, which follow hereto. All percentages, ratios and proportions are by weight, and all temperatures are in degrees Celsius (° C.), unless otherwise specified. All measurements are in SI units, unless otherwise specified. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "plastic" is defined herein as any polymeric material that is capable of being shaped or molded, with or without the application of heat. The term "thermoplastic" is defined herein as a high polymer that softens when exposed to heat and returns to its original condition when cooled. Usually plastics are a homo-polymers or co-polymers of high molecular weight. Plastics fitting this definition include, but are not limited to, polyolefins, polyesters, nylon, vinyl, acrylic, polycarbonates, polystyrene, and polyurethane.

Bag Description

Figure 3:
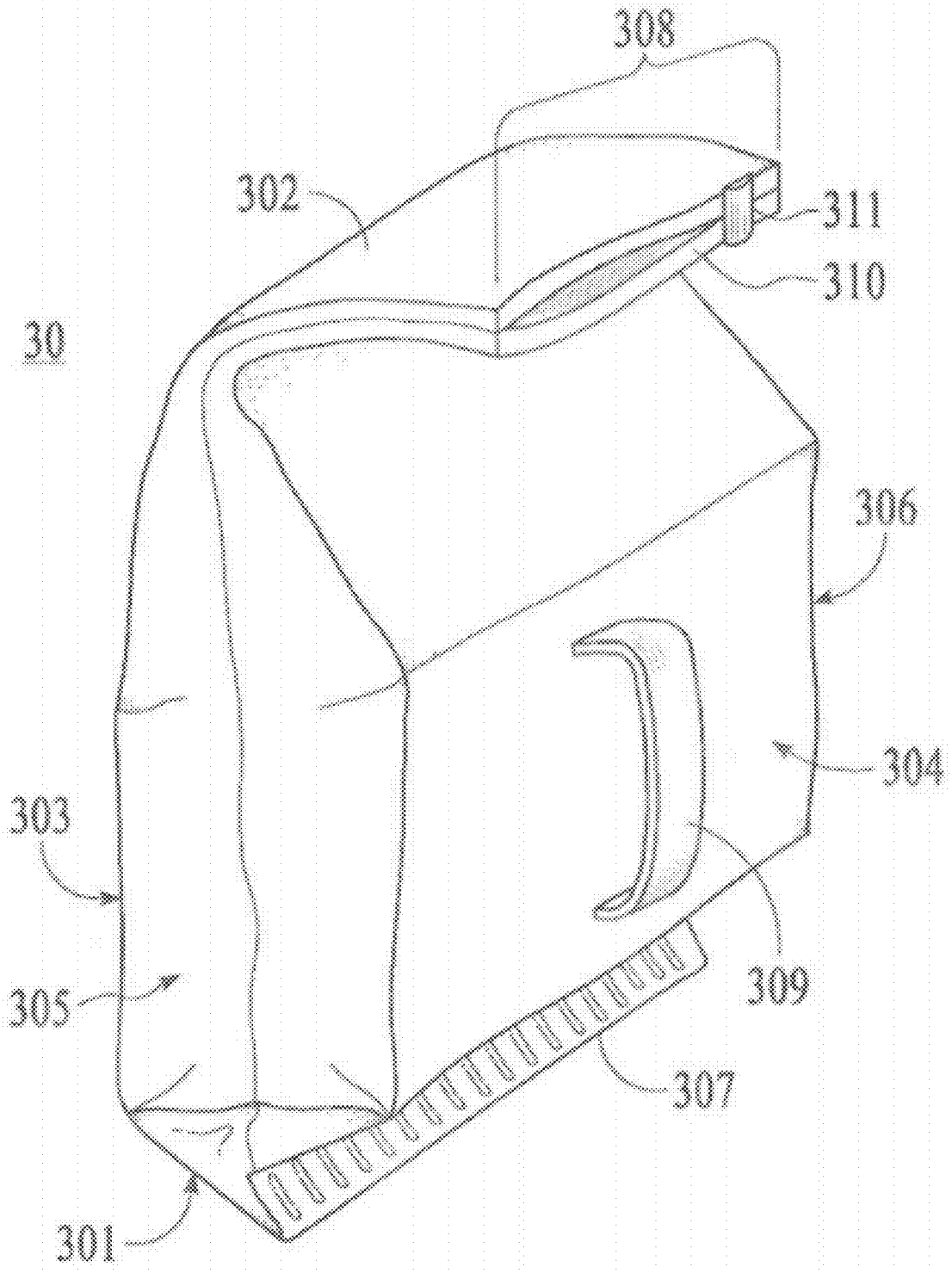
FIG. 3 is a perspective view of a one embodiment of the invention.

In one embodiment of the invention as shown in FIG. 3, the bag is a gusseted roll-top bag 30, having a bottom portion 301, wherein the bag can be closed by folding or rolling down the upper ends 302 of the bag 30. The interior of a bag of this type is suitable for packaging granular materials. The bag 30 generally includes a front panel portion 303, a back panel portion 304, a first side panel portion 305, and a second side panel 306. The bag 30 can also have a transverse end seal 307 on the bag bottom portion 301. The bag can include a vertically attached handle 309, where handle 309 extends in a vertically directed manner from the bag bottom portion 301 toward the bag opening 310. The bag opening 310 contains a slider closure element 311 across the bag top 308.

In an upright flexible bag 30, the side panels 305, 306 are generally shorter in length or equal in length to the adjacent front 303 and/or back panel portion 304. Alternately, the side panels 305, 306 can be defined as those panels that are folded along a gusset at the bag opening 310. As such, these side panels 305, 306 are comparably smaller in width than the panels 303, 304 to provide for the narrower and more efficient folding of the bag top. The first side panel 305, second side panel 306, and the bottom portion 308 can all be gusseted. Similarly, the bag 30 can be formed of non-gusseted, or selectively gusseted panels.

Figure 4:
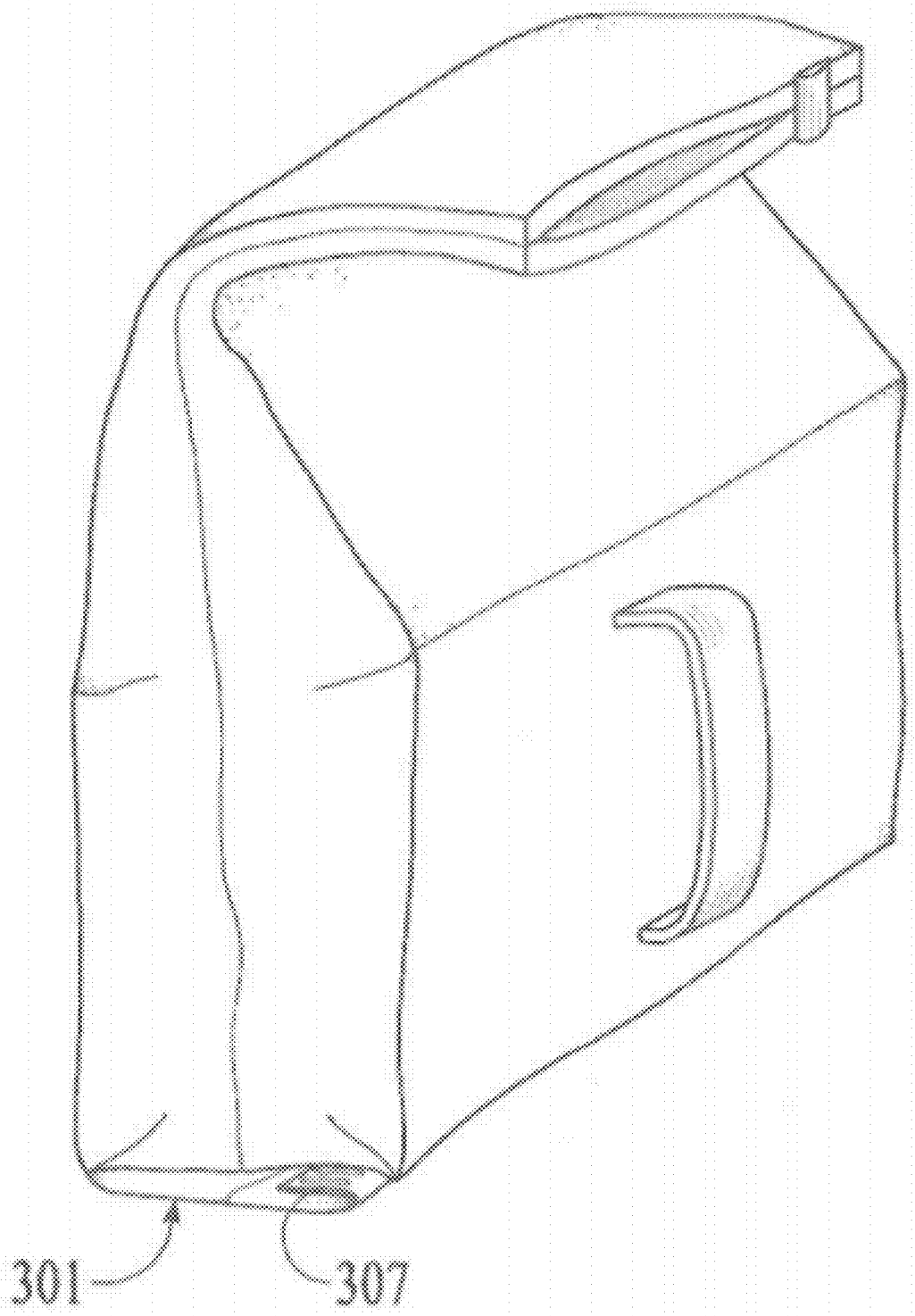
FIG. 4 is a perspective view of a one embodiment of the invention.
Figure 5:
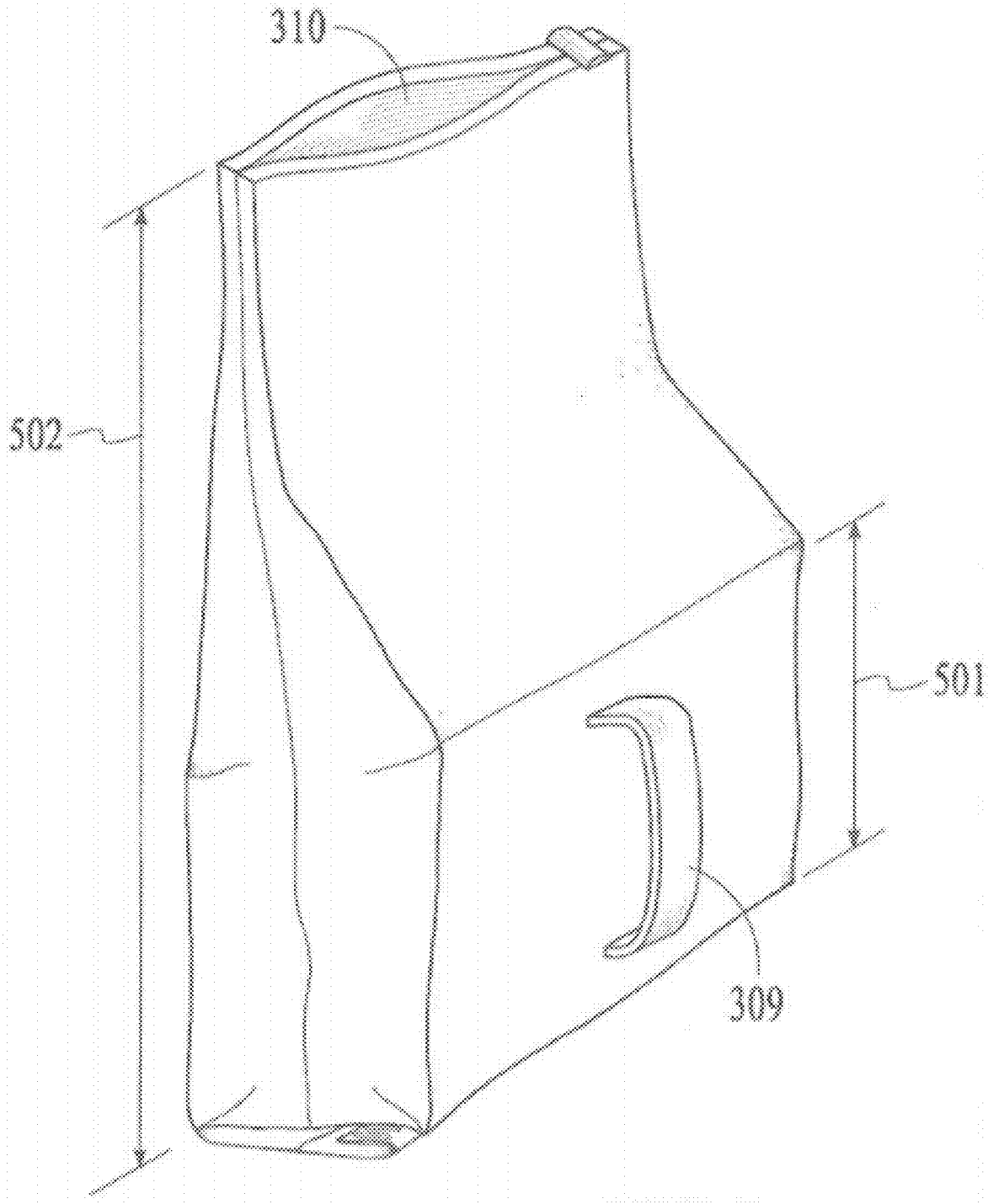
FIG. 5 is a perspective view of one embodiment of the invention.

FIG. 4 shows an embodiment of the bag showing the transverse end seal 307 attached to the bag bottom portion 301. FIG. 5 shows an embodiment where the bag opening 310 is fully extended. In this embodiment the handle 309 is on the bottom portion 501 of the bag extended height 502. Typically, the handle 309 can be in the bottom 50%, or bottom 40%, of the bag extended height 502. Although having the handle 309 on the bottom portion 501 is not advantageous for carrying the extended bag or lifting up the top portion of the bag (typically concerns for traditional bag design), having the handle 309 on the bottom portion 501 is surprisingly ergonomic for pouring out contents, especially if the bag is heavy.

Figure 6:
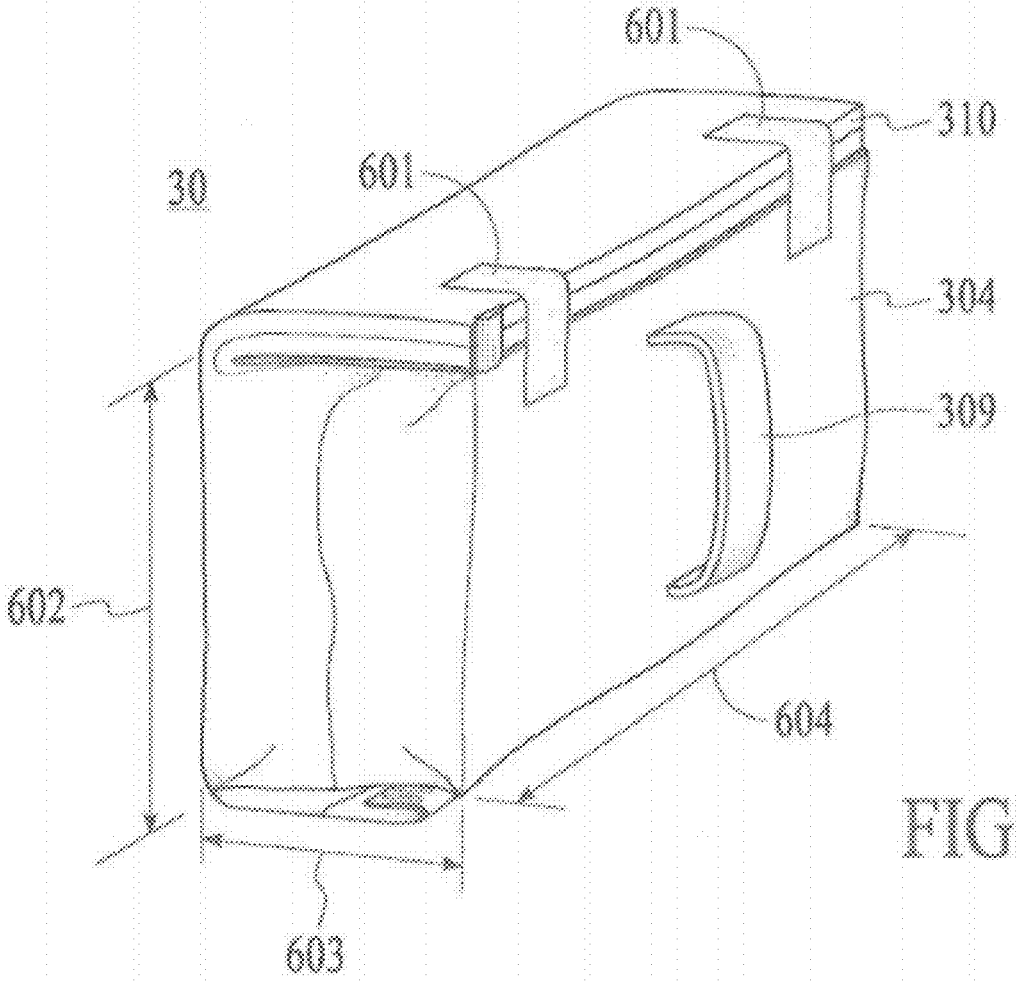
FIG. 6 is a perspective view of one embodiment of the invention.

FIG. 6 shows an embodiment of the bag 30 with the bag opening 310 attached with tape strips 601 to the bag back panel portion 304 containing the vertically oriented handle 309. The bag 30 has a height 602 approximately equal to the width 603 which is generally smaller than the length 604. In an embodiment of the bag 30 designed to be vertically stacked on each other, length 604 is less than two times the height 602. Typically, the ratio of the height 602 to the width 603 is from 1.3 to 1.0, or from 1.2 to 1.0, or from 1.1 to 1.0, or from 1.0 to 1.3, or from 1.0 to 1.2, or from 1.0 to 1.1. A typical bag is about 10.5 inches in length, about 7.75 inches in width, and 8 inches in height, or about 11.75 inches in length, about 9.75 inches in width, and 10 inches in height. In suitable embodiments, the bag height is within 80% to 120% of the bag width when the bag is in the closed position. In suitable embodiments, the bag length is approximately 30% to 50% more than the package width when the bag is in the closed position.

The package of claim 1, wherein the bag length is approximately 30% to 50% more than the package width.

Figure 7:
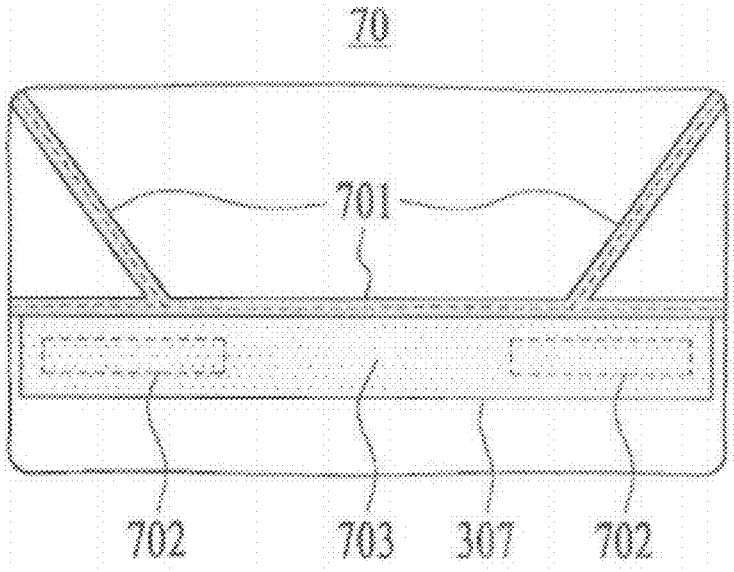
FIG. 7 is a bottom plan view of one embodiment of the invention.
Figure 8:
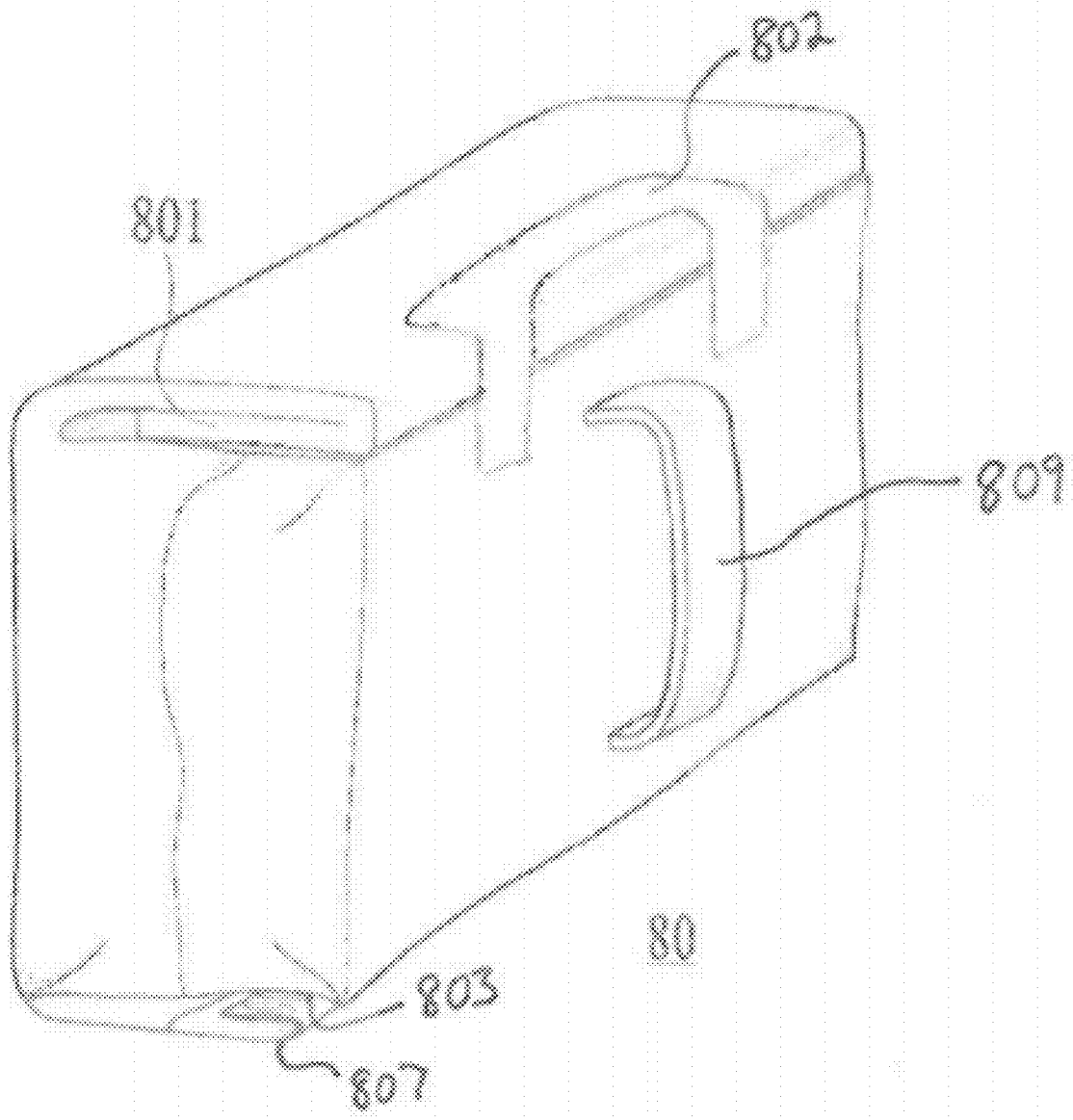
FIG. 8 is a perspective view of one embodiment of the invention.

FIG. 7 shows the bottom portion 70 of the bag in FIG. 6. The bottom portion contains a K seal 701 and a transverse end seal 307. The transverse end seal 307 is attached at the exterior portions 702 but not in the middle portion 703. Leaving an unattached middle portion 703 of the transverse end seal 307 allows the user to grip this unattached middle portion 703 with one hand and to grip the handle 309 (FIG. 6) with the other hand while pouring out the bag contents. FIG. 8 shows a bag 80 having a folded over top opening 801. This may be advantageous where the bag opening might be prematurely opened if not protected, for example where the top closure is a peel seal or a zipper. The bag 80 can have a single tape strip with dual legs 802. The transverse end seal 807 can be sealed at the ends 803 but not in the middle.

Figure 9:
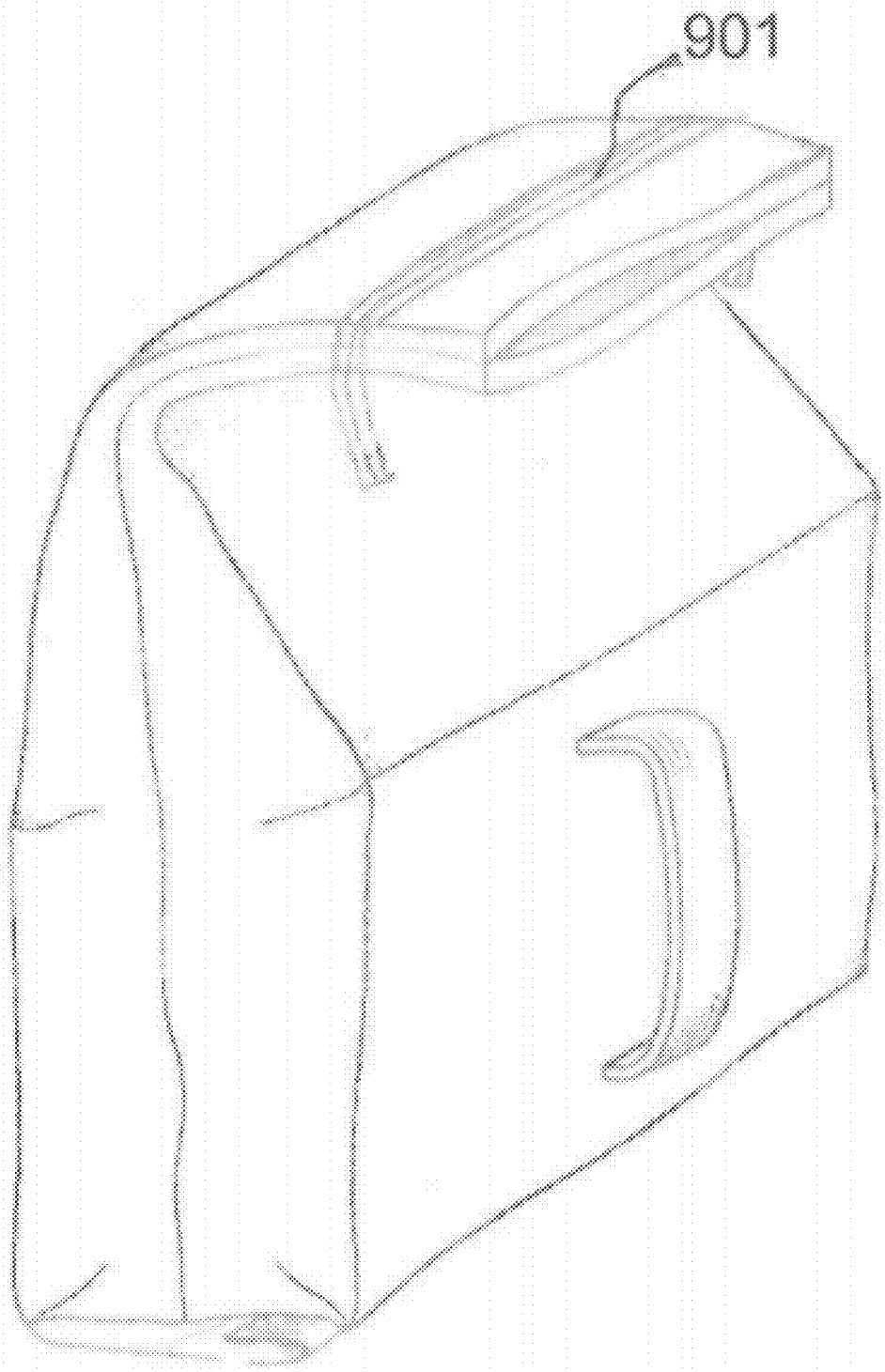
FIG. 9 is a perspective view of one embodiment of the invention.
Figure 10:
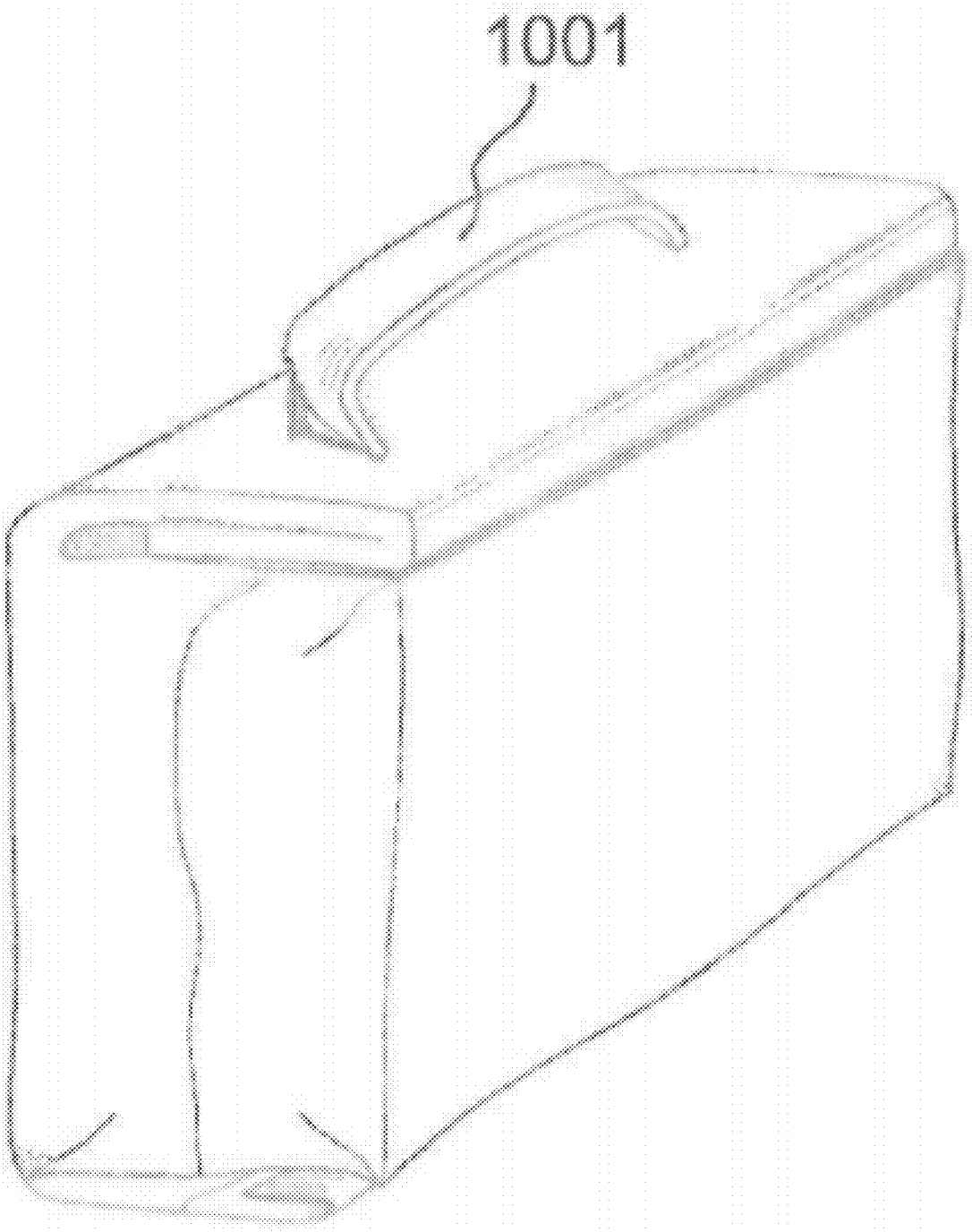
FIG. 10 is a perspective view of one embodiment of the invention.
Figure 11:
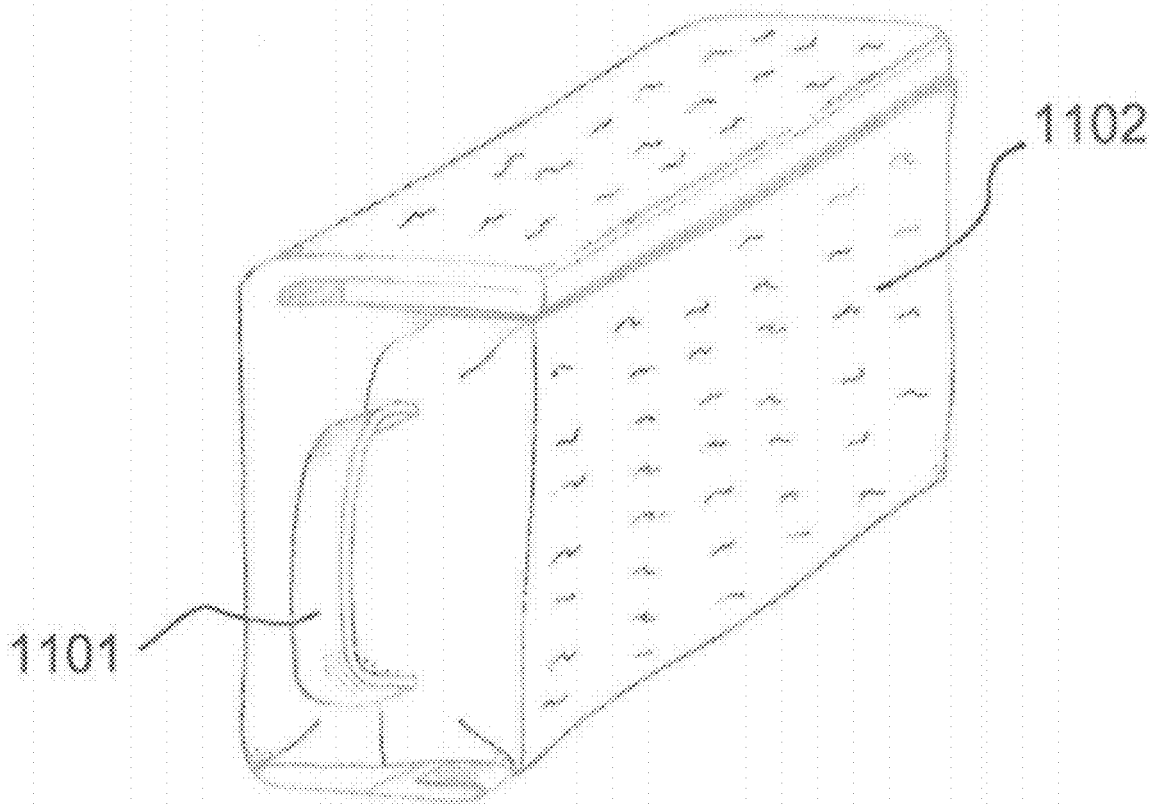
FIG. 11 is a perspective view of one embodiment of the invention.
Figure 12:
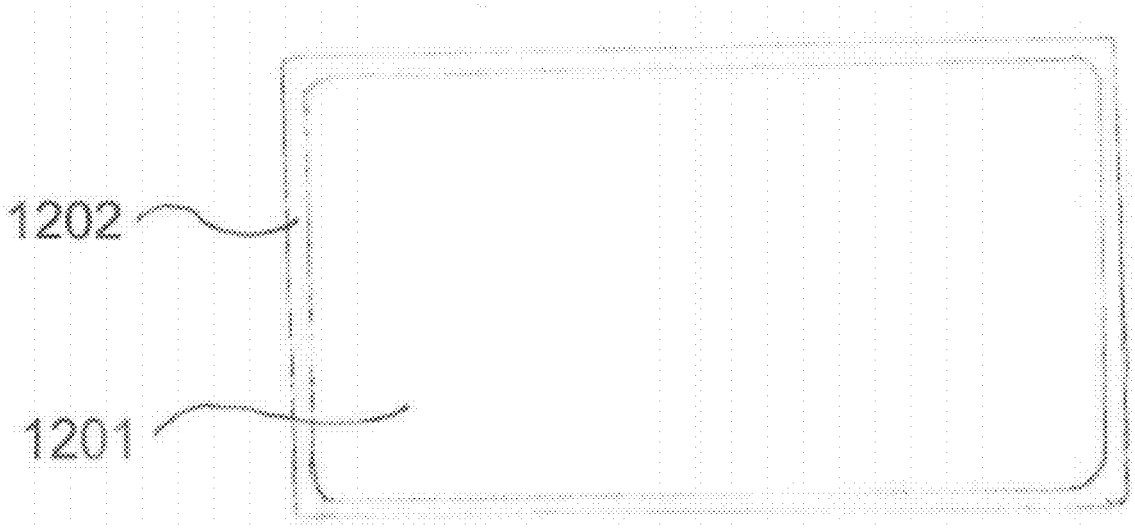
FIG. 12 is a bottom view of one embodiment of the invention.

FIG. 9 shows a partially open bag with a welded wire closure 901. FIG. 10 shows a bag with a top handle 1001. FIG. 11 shows a bag with a side handle 1101 where the bag is made of textured film 1102. FIG. 12 shows a welded flat bottom 1201 of a bag 1200 with an edge weld 1202. Alternatively the bag bottom can be a folded flat bottom, such as described in U.S. Pat. No. 6,692,148 to Totani, which is hereby incorporated herein in its entirety.

Figure 13:
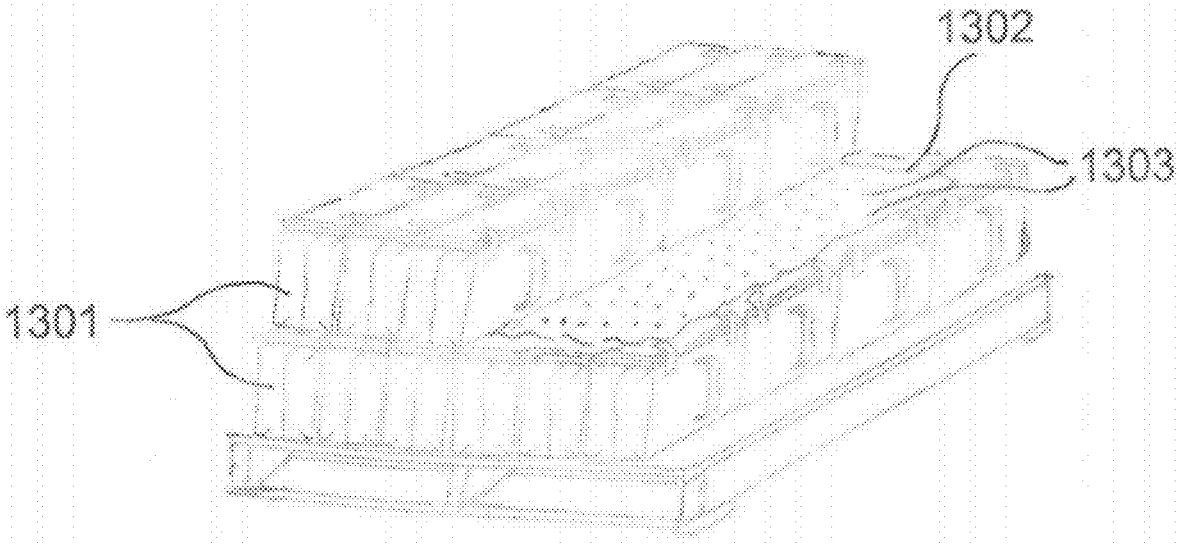
FIG. 13 is a perspective view of one embodiment of the invention.

FIG. 13 shows bags of the invention stacked on a pallet. The vertical stack of bags shows bags 1301 stacked two bags high, at least two bags deep, and at least two bags wide. This may be suitable for stacking on pallets or store shelves, where the double height stacking and larger height facing panel for advertising are both desirable for marketing. Between layers of bags is a tier sheet 1302 having textured dimples 1303. The tier sheet 1302 stabilizes the vertically stacked bags 1301.

Other embodiments of the bag opening contain single or minimal use closures. For instance, a peel seal as described herein can be included without a zipper interlock portion for such embodiments where re-closeability is not desirable or needed. While slider closures are described herein for demonstrative purposes, resealable adhesives/tapes, tin ties or welded wires, snap or screw cap device, snap fastening, hook and latch (Velcro®) fastening, a hinged spout, and other like techniques and devices known to one skilled in the art can be employed for use as the re-closeable bag opening. For instance, U.S. Pat. Nos. 4,909,017, 5,972,396, 5,461,845, 5,672,009, 5,782,733, 5,902,047, 5,954,433, and 6,177,172 are directed to some exemplary re-closeable devices, and other features and techniques for flexible packaging, and are therefore incorporated herein by reference. Conventional "peel seals" known to one skilled in the art can also be implemented in conjunction with bag openings. Various methods for integration of the closure into the bag are described in U.S. Pat. No. 7,040,810 to Steele, which is hereby incorporated in its entirety herein.

Bags can be made from flexible mono-layer or multi-layer film, such as polyethylene, nylon or polyester, are made in a wide-variety of forms that are designed to best contain a particular material, and to also permit the material to be easily and conveniently discharged when desired. The bags are often constructed of flexible sheet material such as polyethylene, polyester, styrene-butadiene, metal foil, polypropylene, or polyethylenes laminated with other materials such as nylon, polyester, and like films. To provide for increased barrier properties, embodiments can use composite layers of such materials and material of the like. Generally, in such composite embodiments, a material having preferred sealing characteristics can be joined, bonded or laminated to a material having a different preferred characteristic (i.e., beneficial oxygen barrier properties). Regardless, single sheets, composites or laminates, and a myriad of other materials and techniques know to one skilled in the art may be implemented based on particular usage and manufacturing needs without deviating from the spirit and scope of the present invention.

Most film technology for bags focuses on reducing friction between the exterior surfaces of adjacent bags. Particularly, films having high friction between two surfaces in contact with one another have been known to cause bags to become stuck in a misaligned position during this automatic packaging process, causing jamming of production equipment and reducing packaging efficiency. Thus, technology has been developed to add antiblock or slip additives to film layers that reduce the coefficient of friction of films. For bags of the invention, the bag surface may be textured through laminates or surface treatments to create a mechanical interlock between the bag and an adjoining bag or secondary material. This interlock can occur in either the horizontal or vertical plane or both. Alternately, a flexible secondary material with texture can be placed above/below or between bags to provide the interlock and prevent or limit sliding. This material could be provided in a solid or flexible sheet form to "tie" together multiple bags in a single plane. For bags of the invention, a sufficient coefficient of static frictions may be necessary to prevent the bags from sliding off each other when vertically stacked. Although the bag material may be smooth, the bag material suitable has an outside texture, for example mesh-like composite as described in U.S. Pat. No. 5,182,162 to Andrusko or using a laminate of a CLAF® mesh material as manufactured by Atlanta Nisseki CLAF, Inc. of Georgia.

Bag Properties

Figure 2:
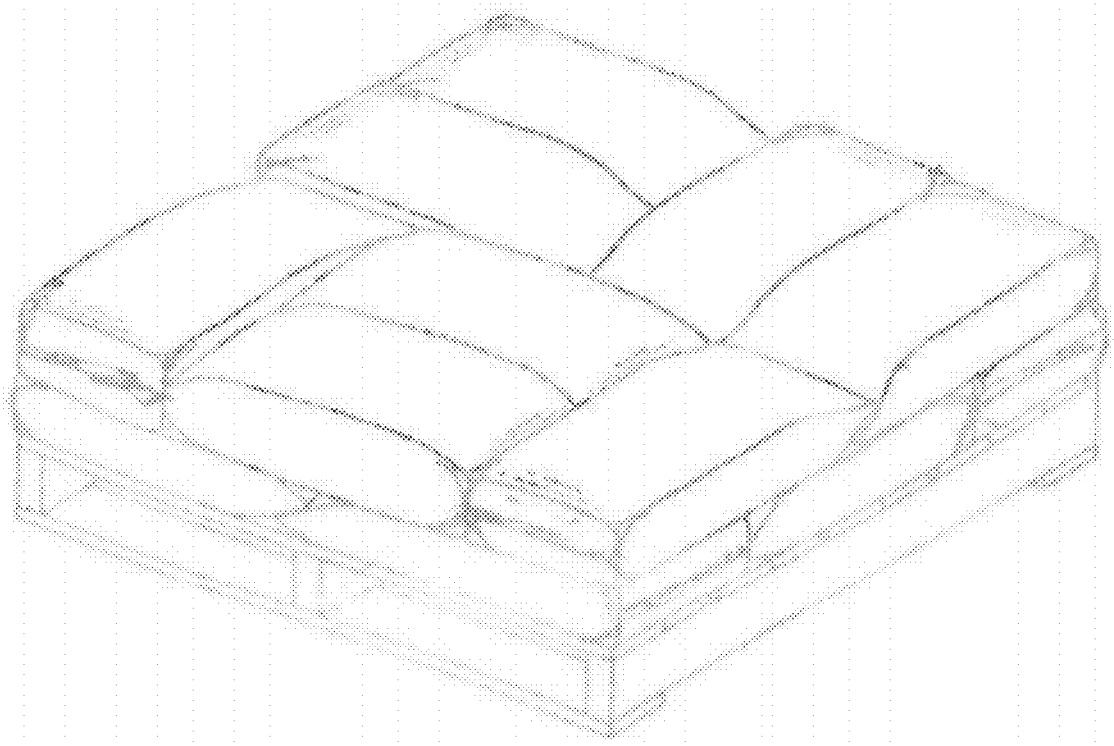
FIG. 2 (Prior Art)
FIG. 2 shows a typical horizontal stacking of bags of the prior art on a pallet.

Bags of the invention as shown in FIG. 13, because of the properties of their contents and the bag properties, can be vertically stacked and have length to width to height ratios that are distinguished from typical shallow bags currently in use that are stacked horizontally (longest dimension is horizontal) as in FIG. 2. For example, shallow, horizontally stacked 20 lbs bags of animal litter (or pet food) currently have dimensions of, for example, 19½ inches by 12 inches by 3½ inches, or 17 inches by 12 inches by 2½ inches, or 17 inches by 7½ inches by 4 inches (length by width by height) and shallow 40 lbs bags of animal litter (or pet food) current have dimensions of, for example, 18 inches by 11½ inches by 6½ inches. Bags of the invention can be stacked vertically as in FIG. 13. Suitable filled bags of the invention have dimensions of (suitable dimensions are 8 inches by 8 inches by 7½ inches, or 11½ inches by 6½ inches by 7½ inches, or 10½ inches by 8 inches by 8½ inches, suitably the height is equal to or greater than the width). Suitable bags contain about 20 lbs. of granular material, or about 30 lbs., or about 40 lbs. of granular material, or about 20 to 40 lbs., or about 20 to 50 lbs. of granular material. Bags of the invention can be stacked vertically without vacuum packing and without reinforced sidewalls. In some embodiments, the bags purposefully retain trapped air to stabilize the vertical stacking of bags.

If the bag contains granular material with limited flow properties (irregular particles such as animal litter), the bag will more easily support the weight of other bags. Bags having optimal tensile strength and creep characteristics and containing granular material with limited flow properties are more easily stacked and shipped vertically on a pallet or shelf without additional support. Suitable bag material having greater tensile strength and creep resistance in reinforced bags (such as heat-weldable woven PP, heat-weldable woven HDPE, or oriented or non-oriented nylon or oriented polypropelene film). Additional suitable material is CLAF woven/nonwoven material Atlanta Nisseki CLAF, Inc. of Georgia.

Suitable bag materials have very low creep values and preferably creep initially in the first 24 hours and then have dramatically reduced creep. Bags of material containing large weights (20-40 lbs) of granular material of limited flow properties having a suitable Coefficient of Friction (COF) can be more easily stacked vertically. Where the content weight is less, the bags can be more easily stacked vertically even with granular materials the flow more easily. For example, normal PET has a static coefficient of friction against the same material of 0.3, Nylon has a static coefficient of friction of 0.4, and modified PET can have a static coefficient of friction of 0.5 to 1.2, or 0.8 to 1.2. Twenty lbs. bags of animal litter in bags of normal PET cannot be stacked vertically, whereas similar bags of Nylon or modified PET can be stacked vertically. Other examples of bag material having a static coefficient of friction of about 0.27 or greater, or of greater than 0.3, or of about 0.4 or greater, are thermally welded woven PP, thermally welded woven PE, and mesh film composites.

Seams can be constructed to absorb impact forces. Geometries having wide gussets, a folded-over shape and shipment orientation and warehousing of vertical bags makes them susceptible to burst of the vertical seams in a bottom drop shipment test. For example, vertical loads can cause creep in seams or adjacent to seams. Shipment vibration can cause fatigue in the seam and adjacent areas reducing the strength of the material (e.g. tensile strength post fatigue is lower than initial). Compaction of the granular material enhances package stability through increased bulk density but this compacted material can create much higher impact forces on the vertical seams. Therefore, it is suitable to minimize the number of seams, for example having one seam or seamless construction. It is also suitable to use seams that allow the bag material to be in tension. In addition, seams that can peel or multiple seams that can sacrificially fail in impact but not in constant compression typical of warehousing or shipment stress are suitable for vertically stacked bags.

Air can be trapped in an air pocket in the top of the bag, for example in the fold-over section and provide a cushion that mitigates fatigue in the side seams and reduces the incidence of burst in dropping the bag onto the bag bottom. Pallet stability is not unduly impaired.

To stabilize the bags on the pallet, it may be suitable to provide a deck sheet across a layer of bags. A thin deck sheet can assume the bag shapes or can be molded to the bag shape. Vertical shipment requires that excess air be removed from the bag, and that the bag be processed into a compact package. It is desirable that this be done in a repeatable way so that the top of the packages are presentable to the consumer. It is also desirable that the excess material at the top of the package be held in place for shipment, such as with tape, or other means. Stacking bags vertically without excess headspace also has a benefit in immobilizing the product in the bag. The stackable bags may allow for stacks of pallet quantities to be shipped without stretch wrap, shrink wrap, stretch hoods, or shrink hoods. When shipped palletized, the pallet can have a shrink hood or stretch hood to provide downward pressure on the pallet. Granular products that would be damaged in shipment by vibration are sufficiently immobilized so that they do not degrade in shipment, such as breaking down from larger particles to smaller ones.

Granular Material with Limited Flow Properties

The bags of the invention contain a granular material with limited flow properties. In one embodiment the granular material is an absorbent material such as animal litter, as described in U.S. Pat. No. 6,887,570 to Greene et al., U.S. Pat. No. 6,962,129 to Lawson, U.S. Pat. No. 7,316,201 to Rasner et al., U.S. Pat. App. 20020117117 to Raymond et al., U.S. Pat. App. 20050175577 to Jenkins et al., U.S. Pat. App. 20050005870 to Fritter et al., and U.S. Pat. App. 20070289543 to Petska et al., which are all incorporated by reference in their entirety herein.

The absorbent material serves to absorb the liquid components of animal wastes. Clay or other absorptive material serves to effectively wick the moisture away to avoid the formation of liquid pooling. A number of absorbent materials are known in the art. Among the absorbent materials that can be used clay or clay in combination with other materials is most commonly used. Nevertheless a variety of other absorbent materials can be used including, but not limited to such adsorbent materials as recycled newspaper paper sludge, corn cob granules, rice hulls, peanut hulls, sunflower hulls, alfalfa, cedar, sawdust, litters made from other organic plant materials and the like. The absorbent material can be any material capable of absorbing a liquid such as animal urine. Many liquid-absorbing materials may be used without departing from the spirit and scope of the present invention. Illustrative absorbent materials include but are not limited to minerals, fly ash, absorbing pelletized materials, perlite, silicas, organics such as cellulosic materials, other absorbent materials and mixtures thereof. Suitable minerals include: bentonites, zeolites, fullers earth, attapulgite, montmorillonite diatomaceous earth, opaline silica, Georgia White clay, sepiolite, calcite, dolomite, slate, pumice, tobermite, marls, attapulgite, kaolinite, halloysite, smectite, vermiculite, hectorite, Fuller's earth, fossilized plant materials, expanded perlites, gypsum and other similar minerals and mixtures thereof.

A suitable absorbent material is sodium bentonite, also known as Wyoming bentonite. Bentonite clays are able to absorb many times their weight of a liquid and agglomerate with nearby wetted bentonite particles to form wet clumps which may be removed from a litterbox. The clay particles are typically comminuted. That is, they are pelletized, ground or formed into particles and screened to a size varying from about 0.05 to about 10,000 microns, although such particle size does not appear critical to the practice of the invention. A suitable particle size for bentonite clay particles is in the range of about 4700 microns to about 50 microns (Ã4×200 U.S. mesh). A suitable bentonite particle size for clumping litter is in the range of about 3000 microns to about 100 microns (Ã7×140 U.S. mesh), and ideally in the range of about 1400 microns to about 300 microns (Ã14×50 U.S. mesh).

Bentonite fines having a size less than about 125 microns (100 U.S. mesh) may also be employed to produce some or all of the particles of absorbent material, and may exhibit both improved absorbency for feline urine and improved dry clump strength. Bentonite fines can be agglomerated through a process called "pin mixing" pursuant to which large amounts of water (up to 30% by weight based on the total weight of the bentonite) are added to the fines and the material is pin mixed under high shear and then dried, ground and sized. Bentonite particles and fines can also be compacted to form particles, as described in U.S. Pat. No. 5,775,259 incorporated herein by reference. The compaction of water-swellable bentonite particles containing bentonite fines may be accomplished by a wide variety of compaction processes known in the art to effect size enlargement of small particles into larger particles. These larger particles are often referred to in the art as agglomerates, and the process of making the larger particles is often referred to as agglomeration. A particularly enlightening treatise on size enlargement by agglomeration is published by John Wiley & Sons, entitled "Size Enlargement by Agglomeration" by, Wolfgang Pietsch, (1991). A wide variety of presses may be used to provide the compacting pressures of this invention so as to form compacted water-swellable bentonite containing an effective amount of bentonite fines. One particularly useful process is the use of a press with rolls. This compaction process is generally referred to as "roll compaction" or "roll pressing", since the material to be compacted is pressed between rollers rotating in opposite directions while applying pressure to continually advancing material. The aforementioned treatise discusses the process of roll compaction at pages 260 to 332, incorporated herein by reference thereto. In one embodiment, compaction is carried out by roll compaction by passing the water-swellable bentonite-containing material through opposing rollers urged together under a selected total pressure of at least 1000 pounds per square inch (gauge), preferably at least 1500 pounds per square inch (gauge) and, further, at a pressure of at least 3500 psig. Roll compaction pressures are often stated in terms of pounds per lineal inch (pli), and pressures of at least 5000 pli are believed suitable, with roll compaction pressures of at least 10,000 pli and more preferably at least 20,000 pli being useful herein. Roll compaction pressures of 28,000 pli have been found usable herein to form the compacted masses which contain effective amounts of bentonite fines. The surfaces of the rolls may be selected from a wide variety of surface textures and designs. The roll surfaces may be smooth or profiled so as to produce a continuous compacted bentonite, having a planar smooth shape, rod-shaped, briquette-shaped, corrugated shape, fluted shape or other selected shapes. After the water-swelled bentonite particles are compacted, the compacted bentonite mass is broken up by passing it through one or more grinding means selected to form a preselected particle size distribution, depending on selected absorbent use, from the compacted bentonite mass. The broken up bentonite mass from the grinding means is then passed through suitable sizing screens to give a final product having a preselected particle size range and/or particle size distribution. Compacted bentonite-containing particles which are too small or too large for the intended use can be recycled for compacting. Alternatively, particles too large for the intended use (e.g., animal litter) can be recycled by regrinding such bentonite particles and recycling the reground particles. Since the instant invention relates in its broadest sense to the compaction of water-swellable bentonite-containing particles containing bentonite fines the actual compaction means used for compacting the bentonite fines is more one of efficiency for commercial manufacturing as contrasted with being critical for obtaining the benefits observed. Among the numerous compacting processes and techniques known in the prior art which may be employed herein, include, but not limited to, pan agglomeration, roll compaction, roll briquetting, vertical hydraulic pressing, rotary tableting, gear pelleting and flat plate pelleting.

A number of types of clays can be used as the absorbent material in the compositions of the present invention. Typical clays used are smectites (including calcium montmorillonites and sodium bentonite), attapulgites, kaolins, and opal clay mixtures. The smectite clays are hydrated aluminum magnesium silicates in the form of either calcium or sodium salts. The term "montmorillonite" is used often in reference to the calcium smectite clays, i.e. calcium montmorillonite clays, and the term "bentonite" is used often in reference to the sodium smectite clays, i.e. sodium bentonite clays. Both calcium montmorillonite and sodium bentonite clays are commonly used as pet litter. Calcium montmorillonite is an acid-activatable clay. Such acid activation can increase the surface area and enhance the absorptive properties of calcium montmorillonite. Sodium bentonite, also known as Wyoming or western bentonite, tends to be less absorptive than calcium montmorillonite. Sodium bentonite and, to a lesser extent, calcium montmorillonite, both swell upon absorbing water to form gel-like masses. The agglomerations of sodium bentonite clay and moist animal wastes form isolatable clumps which can be readily removed from the litter composition. Attapulgite clay, which is hydrous magnesium aluminum silicate, is also commonly used in pet litters. Kaolin, or china clay, and sedimentary opal clay mixtures can also be used in animal litter compositions. Kaolin is a hydrous aluminum silicate of the Kaolinite mineral group. Opal clay contains a grated amount silicon dioxide than bentonite and provides a high porosity and high absorption capacity.

Preferably, the clay component of the compositions of the present invention are, preferably, in an amount of, preferably, about 30% (w/w); more preferably, about 40% (w/w); more preferably, about 50% (w/w); more preferably, about 60% (w/w); more preferably, about 70% (w/w); more preferably, about 75% (w/w); more preferably, about 80% (w/w) (w/w); more preferably, about 85% (w/w); more preferably, about 90% (w/w); more preferably, about 95% (w/w) or greater.

In one embodiment, the material comprises agglomerated clay particles coated with sodium bentonite. In one embodiment, the composition comprises sodium bentonite clay particles with a size of from 420 microns to 2000 microns and compacted sodium bicarbonate particles ranged in size from 600 microns to 2360 microns. In one embodiment, this invention provides an animal litter granule made up of: 20-50 weight-% fine absorbent fibers, preferably 25-45 weight-% fine absorbent cellulose fibers; 10-30 weight-% zeolite, preferably 12-30 weight-% zeolite; 10-70 weight-% mineral filler, preferably 16-61 weight-% mineral filler selected from kaolin, titanium dioxide, calcium carbonate, sodium bicarbonate, and mixtures thereof; and 0.5-10 weight-% binder, preferably 0.5-3 weight-% acrylic binder.

Activated alumina ($Al_2O_3$) has been found to provide odor control comparable or even superior to other odor control additives such as activated carbon, zeolites, and silica gel. Alumina is a white granular material, and is properly called aluminum oxide. Typical aluminas include or are derived from gibbsite, boemite, pseudo boemite, and bauxite, each alumina potentially having different properties. The Bayer refining process used by alumina refineries worldwide involves four steps—digestion, clarification, precipitation and calcination. To turn bauxite into alumina, the ore is ground and mixed with lime and caustic soda. The mixture is pumped into high-pressure containers, and heated. The aluminum oxide is dissolved by the caustic soda, then precipitated out of this solution, washed, and heated to drive off water. One process of making activated alumina includes a heating step, which dries and cracks the alumina particles to create fissures and pores that increase the absorptive ability of the alumina. The resulting product is a white, free flowing powder with a bulk density of about 40-60 lbs/ft$^3$. A commercial supplier of activated alumina suitable for use in the embodiments presented herein is Alcoa, 201 Isabella Street, Pittsburgh, Pa. 15212-5858 USA. The preferred activated alumina material has been activated by a heat process, though chemical activation processes can also be used. The particle size of the alumina may be important to avoid segregation issues, namely that alumina having a particle size substantially smaller than the absorbent particles will tend to settle towards the bottom of the mixture. This settling may affect odor controlling properties of the alumina due to its physical location in the package (the amount of alumina in the mixture is not consistent) as well as in a litter box (the alumina should be generally homogenous throughout the mixture or located towards the top of the litter box where odors tend to escape to the atmosphere). Therefore, the preferred particle size of the activated alumina is selected such that it will not substantially segregate out of the mixture. This determination can be made on the basis of the particle size of alumina relative to the particle size of the absorbent material and additives, density of the materials relative to each other, etc. For example, where the absorbent material consists mainly of dried and crushed sodium bentonite particles in the particle size range of about 1.4 mm-0.3 mm (14×50 mesh), the activated alumina particles are preferably in the range of about 1-2 mm (10×18 mesh). Because the smaller particle size may improve odor controlling properties of activated alumina, powdered activated alumina can be coated onto the particles of absorbent material. Also, the activated alumina can be formed into composite particles with one or more absorbent materials and optional additives. A description of such composite particles is provided below. Particles of activated alumina in an effective amount can be dry mixed with the other components of the absorbent composition. Preferably, the activated alumina is present in the composition in an amount of about 0.01% to about 50% of the composition by weight based on the total weight of the absorbent composition. More preferably, the activated alumina is present in the composition in an amount of about 0.1% to about 25% by weight. Absorbent compositions can also be formed from 100% activated alumina. Other compositions can be formed primarily of activated alumina (e.g., >80-90%) with other additives and absorbent materials.

In one embodiment, silica gel can serve an odor-controlling function in the composition. The silica gel is, suitably, Type C silica gel and the composition comprises, preferably, from about 5% to about 50% (w/w) silica gel. The silica gel is, preferably, in the form of particles having an average pore diameter from about 8 nm. to about 10 nm. In one embodiment, at least 90% (w/w) of the silica gel particles comprises silica gel particles having a diameter of from about 1 mm to about 5 mm.

In one embodiment, the absorbent contains fine absorbent fibers having a length of 1-3 millimeters and a moisture content of less than 15 weight-%, and may be cellulosic fibers selected from the group consisting of wood dust, paper fibers, vegetable fibers, and mixtures thereof. The absorbent may contain zeolite such as clinoptilolite having a particle size range with the range 10 to 100 microns and having a moisture content of less than 12 weight-%. The mineral filler may have a particle size range within the range 10 to 150 microns and a moisture content of less than 12 weight-%, and may be selected from lime, fly ash, dolomite, calcium carbonate, and mixtures thereof. The acrylic binder may be an acrylic/methacrylic copolymer in aqueous dispersion. Suitable superabsorbent materials include superabsorbent polymers such as AN905SH, FA920SH, and F04490SH, all from Floerger. Preferably, the superabsorbent material can absorb at least 5 times its weight of water, and ideally more than 10 times its weight of water.

Suitable antimicrobial actives are boron containing compounds such as borax pentahydrate, borax decahydrate, boric acid, polyborate, tetraboric acid, sodium metaborate, anhydrous borate, boron components of polymers, and mixtures thereof. The antimicrobial active can be added as a solid and dry mixed into the mixture, or can be sprayed onto the particles in the mixture. Antimicrobial actives are preferably added in an amount of up to about 1%. More information about the effects of boron-containing compounds in cat litter is found in U.S. Pat. No. 5,992,351, which is herein incorporated by reference. The animal litter granule of this invention may further include 0.5-3 weight-% of a boron compound urease inhibitor, for instance, boric acid having a particle size range within the range 10 to 100, U.S. Sieve Series, and having a moisture content of less than 10 weight-%. The granule alternatively or additionally may further include 1-3 weight-% of a pH buffer for maintaining the pH of the granule below 7.0. In a suitable embodiment, the pH buffer maintains the pH of the granule at a pH of approximately 6.0 and is selected from potassium phosphate and sodium bicarbonate. The granule alternatively or additionally may further include 1-4 weight-% dry binder, for instance selected from starch, guar gum, and mixtures thereof. In a preferred embodiment, the dry binder is unmodified starch granules, 70% of which pass through 200 Mesh U.S. Sieve Series.

In another aspect of the present invention, the composition, in certain embodiments, can further comprise an odor masking agent. By odor masking agent it is meant that the agent acts to diminish perception of the odor without necessarily altering the amount of odor released from the animal litter upon its use. Any of a variety of perfumes, fragrances and essential oils can be used as the odor masking agent, including natural essential oils. The odor-masking agent may be encapsulated such as in encapsulated fragrance powders or incorporated into a carrier system, a number of which are known in the art (See, for example, U.S. Pat. Nos. 4,085,704; 4,898,727; 4,561,997; 5,240,699; 5,035,886; and 5,336,665). In certain embodiments, silica gel can be used as a carrier. Other illustrative additives include but are not limited to antimicrobials, odor absorbers/inhibitors, binders, dedusting agents, fragrances, health indicating materials, nonstick release agents, superabsorbent materials, lightweight materials, colorants, and mixtures thereof. One type of odor absorbing/inhibiting active inhibits the formation of odors. An illustrative material is a water soluble metal salt such as silver, copper, zinc, iron, and aluminum salts and mixtures thereof. Suitable metallic salts are zinc chloride, zinc gluconate, zinc lactate, zinc maleate, zinc salicylate, zinc sulfate, zinc ricinoleate, copper chloride, copper gluconate, and mixtures thereof. Other odor control actives include metal oxide nanoparticles. Additional types of odor absorbing/inhibiting actives include cyclodextrin, zeolites, activated carbon, acidic, salt-forming materials, and mixtures thereof.

Nonstick release agents such as calcium bentonite or baking soda can be added to reduce and potentially eliminate sticking to a litter box. The additive may also include a clumping aid or binder such as lignin sulfonate (solid), polymeric binders, fibrillated Teflon® (polytetrafluoroethylene or PTFE), and combinations thereof. Useful organic polymerizable binders include, but are not limited to, carboxymethylcellulose (CMC) and its derivatives and its metal salts, guar gum cellulose, xanthan gum, starch, lignin, polyvinyl alcohol, polyacrylic acid, styrene butadiene resins (SBR), and polystyrene acrylic acid resins. Water stable composite particles can also be made with crosslinked polyester network, including but not limited to those resulting from the reactions of polyacrylic acid or citric acid with different polyols such as glycerin, polyvinyl alcohol, lignin, and hydroxyethylcellulose. The natural tendency of bentonite and other inorganic clays is to form dust upon handling as a result of attrition of the particles during handling and shipping. Dedusting agents such as colloidal polytetrafluoroethylene can be added to the particles in order to reduce the dust ratio. Many of the binders listed above are also effective dedusting agents when applied to the outer surface of the absorbent particles. Other dedusting compounds or agents include but are not limited to gums, water-soluble polymeric resins, e.g., polyvinyl alcohol, polyvinyl acetate, polyvinyl pyrrolidone, polyacrylic acid, xanthan gum, gum arabic, other natural resins and mixtures of any of these resins.

A color altering agent such as a dye, pigment, bleach, lightener, etc. may be added to vary the color of particles, such as to lighten the overall color of the litter so it is more appealing to an animal, aid a consumer in distinguishing the alumina from the other materials, etc. For instance, suitable dyes include, but are not limited to, direct dyes, vat dyes, sulfur dyes, acid dyes, mordant acid dyes, premetalized acid dyes, basic dyes, dispersed dyes, reactive dyes, azo dyes, phthalocyanine dyes, anthraquinone dye, quinoline dyes, monoazo, diazo and polyazo dyes, and suitably treated titanium dioxide. Preferred dyes include anthraquinone, quinoline and monoazo dyes. Especially preferred dyes are polymeric dyes (e.g., dyes that are covalently bonded to polymers). Illustrative pigments include phthalo pigments. Other types of color altering agents include non-staining coloring agents, especially of the type that do not stain the material to which applied until dried. Additionally, activated alumina's natural white coloring makes it a desirable choice as a white, painted or dyed "speckle" in litters. In composite and other particles, the activated alumina can also be added in an amount sufficient to lighten or otherwise alter the overall color of the particle or the overall color of the entire composition. Compositions may also contain visible but ineffective colored speckles for visual appeal. Examples of speckle material are salt crystals or gypsum crystals. Preferably, the color altering agent comprises up to approximately 5% of the absorbent composition, more preferably, 0.001%-1% of the composition. Even more preferably, the color altering agent comprises approximately 0.001%-0.01% of the composition. In a further aspect of the invention, the color altering agent is disposed on one or more of the materials such that at least 10% of the overall absorbent composition is colored. More preferably, the colorant agent is disposed on at least 20% of the materials. Zeolite, alumina and silica gel are preferred carriers for the color altering agent. Zeolite is preferred, as it has a density similar to that of bentonite, the preferred primary absorbent material, and so will not tend to significantly migrate during packaging, transport, or use. According to the invention, the color altering agents may be any color, even yellow. An effective amount of dye or pigment is that which is perceived by consumers to be preferred over uncolored litter. One well established method of assessing the effectiveness of the dye or pigment is by measuring the litter composition resistance to color changes in the b region (or coordinate) of the L,a,b color scale when soiled by animal urine. As is well known in the art, the L,a,b color scale is a uniform color system developed by Hunterlab to represent colors. See, e.g., Kirk-Othmer, *Encyclopedia of Chemical Technology*, $4^{th}$ Ed., Vol. 11, p. 238 (1994); R. S. Hunter, *Instruments and Test Methods for Control of Whiteness in Textile Mills*, Proceedings of the American Association of Textile Chemists and Colorists, 1966 National Technical Conference (1966).

Fragrances (such as those available from such commercial vendors as Quest, Sozio, Bush Boake and Allen, Firmenich, Mane U.S.A., International Flavours and Fragrances, Inc., Dragoco, Noville, Belmay and Givaudan) are optionally added. Such fragrances can additionally be uncoated (e.g., fragrance blends) or encapsulated (as in U.S. Pat. No. 4,407,231). Fragrance can be added in an amount up to about 10%, preferably up to about 5%, and ideally in an amount less than about 1%. Fragrances can include those that are aesthetically appealing to a human or that mask odor. Other fragrances include animal attractants.

Animal health indicating actives may also be added to the composition, or packages separately for addition to the mixture in the litter box. One such active includes a pH indicator that changes color when urinated upon, thereby indicating a health issue with the animal. U.S. Pat. No. 6,308,658, incorporated by reference, describes a litmus agent that visually indicates the presence of a urinary infection in animals. Another type of active detects and indicates occult blood in animal urine.

Because minerals, and particularly clay, are heavy, it is may be desirable to reduce the weight of the absorbent by forming composite absorbent particles to reduce shipping costs, reduce the amount of material needed to need to fill the same relative volume of the litter box, and to make the material easier for customers to carry. Exemplary lightweight materials that may be added to the composition include but are not limited to calcium bentonite clay, attapulgite clay, perlite, silica, zeolite, non-absorbent silicious materials, sand, plant seeds, glass, polymeric materials, wood pulp and other cellulosics, and mixtures thereof. As an example, the preferred absorbent material is sodium bentonite, which has a density of about 70 lbs/$ft^3$. By adding a lighter material such silica (25 lbs/$ft^3$) or zeolite (about 50 lbs/$ft^3$), the overall weight per volume unit of the mixture can be reduced. The present invention also includes compositions that incorporate composite particles containing absorbent material and optionally performance-enhancing actives (activated alumina and/or other additives). For example, the composite particles can be formed of the absorbent material alone, absorbent material+alumina, absorbent material+additives, and absorbent material+alumina+additives. The absorbent compositions can include combinations of any of these particles, and can also include particles of alumina and/or additives dry mixed with the composite particles.

The composite absorbent particles have improved physical and chemical properties. By using the processes and materials described in U.S. Pat. App. 2005/0005869, filed Jul. 11, 2003, which is herein incorporated by reference, as well as activated alumina as an active, such particles can be "engineered" to preferentially exhibit specific characteristics including but not limited to improved odor control, lower density, easier scooping, better particle/active consistency, higher clump strength, etc. One of the many benefits of this technology is that the alumina and/or other performance-enhancing actives may be positioned to optimally react with target molecules such as but not limited to odor causing volatile substances, resulting in surprising odor control with very low levels of active ingredient. One great advantage of the particles of the present invention is that substantially every absorbent particle can be made to contain activated alumina. One or more performance-enhancing actives (additives) are preferably added to the particles in an amount effective to perform the desired functionality or provide the desired benefit. For example, these actives can be added during the agglomeration process so that the actives are incorporated into the particle itself, or can be added during a later processing step. Illustrative materials for the performance-enhancing active(s) include but are not limited to activated alumina, antimicrobials, odor absorbers/inhibitors, binders, fragrances, health indicating materials, nonstick release agents, superabsorbent materials, and mixtures thereof. The composite particles can be dry mixed with other types of particles, including but not limited to other types of composite particles, extruded particles, particles formed by crushing a source material, etc. Mixing composite particles with other types of particles provides the benefits provided by the composite particles while allowing use of lower cost materials, such as crushed or extruded bentonite. Illustrative ratios of composite particles to other particles can be 75/25, 50/50, 25/75, or any other ratio desired. For example, in an animal litter created by mixing composite particles with extruded bentonite, a ratio of 50/50 will provide enhanced odor control, clumping and reduced sticking, while reducing the weight of the litter and lowering the overall cost of manufacturing the litter. The composite particles can also be dry mixed with actives, including but not limited to particles of activated alumina and additives bound to carriers.

One preferred method of forming the absorbent particles is by agglomerating granules of an absorbent material in a pan agglomerator. A preferred pan agglomeration process is set forth in more detail below, but is described generally here to aid the reader. Generally, the granules of absorbent material are added to an angled, rotating pan. A fluid or binder is added to the granules in the pan to cause binding of the granules. As the pan rotates, the granules combine or agglomerate to form particles. Depending on pan angle and pan speed among other factors, the particles tumble out of the agglomerator when they reach a certain size. The particles are then dried and collected. The agglomeration process in combination with the unique materials used allows the manufacturer to control the physical properties of particles, such as bulk density, dust, strength, as well as PSD (particle size distribution) without changing the fundamental composition and properties of absorbent particles. One benefit of the pan agglomeration process of the present invention is targeted active delivery, i.e., the position of the active can be "targeted" to specific areas in, on, and/or throughout the particles. Another benefit is that because the way the absorbent particles are formed is controllable, additional benefits can be "engineered" into the absorbent particles, as set forth in more detail below.

The diverse types of clays and mediums that can be utilized to create absorbent particles should not be limited to those cited above. Further, unit operations used to develop these particles include but should not be limited to: high shear agglomeration processes, low shear agglomeration processes, high pressure agglomeration processes, low pressure agglomeration processes, mix mullers, roll press compacters, pin mixers, batch tumble blending mixers (with or without liquid addition), and rotary drum agglomerators. For simplicity, however, the larger portion of this description shall refer to the pan agglomeration process, it being understood that other processes could potentially be utilized with similar results. Other particle-forming processes may be used to form the composite particles of the present invention. For example, without limitation, extrusion and fluid bed processes appear appropriate. Extrusion process typically involves introducing a solid and a liquid to form a paste or doughy mass, then forcing through a die plate or other sizing means. Because the forcing of a mass through a die can adiabatically produce heat, a cooling jacket or other means of temperature regulation may be necessary. The chemical engineering literature has many examples of extrusion techniques, equipment and materials, such as "Outline of Particle Technology," pp. 1-6 (1999), "Know-How in Extrusion of Plastics (Clays) or Non-Plastics (Ceramic Oxides) Raw Materials, pp. 1-2, "Putting Crossflow Filtration to the Test," *Chemical Engineering, pp.* 1-5 (2002), and Brodbeck et al., U.S. Pat. No. 5,269,962, especially col. 18, lines 30-61 thereof, all of which is incorporated herein by reference thereto. Fluid bed process is depicted in Coyne et al., U.S. Pat. No. 5,093,021, especially col. 8, line 65 to col. 9, line 40, incorporated herein by reference.

The composite absorbent particle can be formed into any desired shape. For example, the particles are substantially spherical in shape when they leave the agglomeration pan. At this point, i.e., prior to drying, the particles may have a high enough moisture content that they are malleable. By molding, compaction, or other processes known in the art, the composite absorbent particle (as well as any of the particles described herein) can be made into spheres and non-spherical shapes such as, for example, ovals, flattened spheres, hexagons, triangles, squares, etc. and combinations thereof.

It should be noted that the compositions of the present invention can be used in litter boxes or in cages of a wide variety of animals including common pets, cats, dogs, gerbils, guinea pigs, mice and hamsters, rabbits, ferrets and laboratory animals (e.g., mice, rats, and the like). The animal litter of the present invention is especially useful for smaller household animals, such as cats. The compositions described above can be used as a "clumping" animal litter to selectively remove liquid animal wastes from a weight of animal litter by: contacting the animal litter with liquid animal waste thereby producing an agglomerated mass (generally referred to as a "clump") comprising the animal litter and the liquid animal waste that is of sufficient size and of sufficient clumping strength to be removed from the litter and a remaining amount of litter; and removing the clump from the remaining amount of litter. Although the clump can be removed as a wet clump, owing to the use patterns of cat owners the clump is generally removed after it has dried at room temperature for a period of about 24 hours, thereby effectively removing the liquid animal waste from the remaining amount of litter. Owing to the moisture on the surface of solid animal wastes, the instant litters are also effective in adhering to solid animal wastes. In addition, the animal litter can be used with litter boxes of known designs. Such litter boxes are water-impermeable receptacles having disposed therein a litter comprising a compacted bentonite according to this invention and capable of agglomerating upon wetting into a clump of sufficient size and of sufficient clump strength for physical removal of the clump from the litter box. The removal of the clump is without substantial adherence to an animal, when either a wet clump or dry clump form.

As mentioned above, the compositions described herein have particular application for use as an animal litter. However, the particles should not be limited to pet litters, but rather could be applied to a number of other applications such as: Litter Additives—Formulated product can be pre-blended with standard clumping or non-clumping clays to create a less expensive product with some of the benefits described herein. A post-additive product could also be sprinkled over or as an amendment to the litter box. Filters—Air or water filters could be improved by either optimizing the position of activated alumina and actives into areas of likely contact, such as the outer perimeter of a filter particle. Composite particles with each subcomponent adding a benefit could also be used to create multi-functional composites that work to eliminate a wider range of contaminants. Bioremediation/Hazardous/Spill Cleanup—The absorbent compositions described herein are useful for absorbing spilled liquid such as oil spills. Absorbents with actives specifically chosen to attack a particular waste material can also be engineered using the technology described herein. Exemplary waste materials include toxic waste, organic waste, hazardous waste, and non-toxic waste. Pharma/Ag—Medications, skin patches, fertilizers, herbicides, insecticides, all typically use carriers blended with actives. Utilization of the technology described herein reduce the amount of active used (and the cost) while increasing efficacy. Soaps, Detergents, and other Dry Products—Most dry household products could be engineered to be lighter, stronger, longer lasting, or cheaper using the technology as discussed herein. Mixtures of Different Particles—The particles can be dry mixed with other types of particles, including but not limited to other types of composite particles, extruded particles, particles formed by crushing a source material, etc. Mixing various types of particles provides the desired benefits while allowing use of lower cost materials, such as crushed or extruded bentonite. Where composite particles are used, illustrative ratios of composite particles to other particles can be 75/25, 50/50, 25/75, or any other ratio desired. For example, in an animal litter created by mixing composite particles with extruded bentonite, a ratio of 50/50 will provide enhanced odor control, clumping and reduced sticking, while reducing the weight of the litter and lowering the overall cost of manufacturing the litter. Mixtures of Composite Particles with Actives—The composite particles can be dry mixed with actives, including but not limited to particles of activated carbon.

While this detailed description includes specific examples according to the invention, those skilled in the art will appreciate that there are many variations of these examples that would nevertheless fall within the general scope of the invention and for which protection is sought in the appended claims.

What is claimed is:

1. A vertical stack of bags on a pallet comprising:

at least two bags high, at least two bags deep, and at least two bags wide, wherein each bag has a bag height and a bag width, said bag height within 80% to 120% of said bag width and wherein each bag has an exterior surface having a static coefficient of friction of about 0.27 or greater; and wherein each bag comprise a flat bottom portion, a front portion, a back portion having a handle, two gusseted side portions, a top portion comprising a top opening having a closure, an interior cavity containing about 20 to 50 lbs. of a granular material having limited flow properties, wherein the top part of the front portion is folded and affixed to the back portion adjacent to the handle when the bag is in a closed position and wherein the handle defines a length thereof that is vertically oriented on the bottom half of the back portion when the bag is fully extended in an open upright position.

2. The stack of bags of claim 1, wherein each bags exterior has an exterior surface having a static coefficient of friction of 0.3 or greater.

3. The stack of bags of claim 1, wherein the bags are without vacuum packing and without reinforced sidewalls.

4. The stack of bags of claim 1, wherein the granular material has an average particle size in the range of about 3000 microns to about 100 microns.

5. The stack of bags of claim 1, wherein the closure is a slider.

6. The stack of bags of claim 1, wherein the closure is a wire closure.

7. The stack of bags of claim 1, wherein the bag comprises nylon.

8. The stack of bags of claim 1, wherein the bag comprises a film selected from the group consisting of a mesh film composite a woven plastic material, a paper composite, and combinations thereof.

9. The stack of bags of claim 1, wherein the bag comprises a textured film.

10. The stack of bags of claim 1, wherein the at least two bags high, at least two bags deep, and at least two bags wide form a first layer and a second layer of bags, said first layer comprising at least one bag high, at least one bag deep and at least one bag wide and said second layer of bags comprising at least one bag high, at least one bag deep and at least one bag wide and there is a textured tier sheet between the the first layer and the second layer.

* * * * *